United States Patent [19]

Lostumo

[11] Patent Number: 5,022,874

[45] Date of Patent: Jun. 11, 1991

[54] MINIATURE HIGH VOLTAGE CONNECTOR

[75] Inventor: Arthur J. Lostumo, Franklin Park, Ill.

[73] Assignee: Zenith Electronics Corporation, Glenview, Ill.

[21] Appl. No.: 589,726

[22] Filed: Sep. 28, 1990

[51] Int. Cl.[5] ..... H01R 11/09; H01R 13/52

[52] U.S. Cl. ..... 439/724; 439/736; 439/275; 439/279

[58] Field of Search ..... 439/723, 724, 736, 275, 439/271, 465, 470, 507, 512, 513, 786, 787, 796, 722

[56] References Cited

U.S. PATENT DOCUMENTS

| | | | |
|---|---|---|---|
| 2,241,419 | 5/1941 | Peters | 174/84 |
| 3,665,376 | 5/1972 | Paris et al. | 439/722 |
| 3,824,526 | 7/1974 | Glover | 339/94 R |
| 3,842,390 | 10/1974 | Glover et al. | 339/14 R |
| 3,941,928 | 3/1976 | Gaind | 178/7.8 |
| 4,019,796 | 4/1977 | Issler et al. | 339/12 R |
| 4,077,697 | 3/1978 | Yates | 439/724 X |
| 4,343,526 | 8/1982 | Hobson et al. | 339/90 R |
| 4,387,947 | 6/1983 | Lostumo et al. | 339/90 R |
| 4,653,842 | 3/1987 | Kirma | 439/723 X |
| 4,715,827 | 12/1987 | Furman | 439/465 |
| 4,854,899 | 8/1989 | Matthews | 439/724 |

*Primary Examiner*—Larry I. Schwartz
*Assistant Examiner*—Julie R. Daulton

[57] ABSTRACT

A miniature high voltage connector for a CRT including a rubber receptacle having a common conductor plate insert molded therein. A clam shell housing for the receptacle engages the conductors and prevents their withdrawal from the receptacle.

11 Claims, 3 Drawing Sheets

MINIATURE HIGH VOLTAGE CONNECTOR

BACKGROUND OF THE INVENTION

Television receivers utilize a high potential voltage for operation of its cathode ray tube (CRT) display. In a typical receiver an alternating polarity signal associated with CRT scanning is converted by a high voltage transformer and rectifier to a single polarity high voltage potential for CRT operation.

This scanning signal is generated by components located on a receiver chassis that is manufactured separately from the CRT, and the chassis and CRT are later combined in a cabinet during final assembly and appropriate connections are made between the above-described high voltage scanning signal and a CRT anode. This connection is effected by quick release connectors that are readily separable instead of being permanently soldered together.

Because of the high voltage, the connector connections are susceptible to arcing which can cause gas production and deterioration of the connector parts.

In the past, these quick release connectors because of the requirements for conductor engagement, sealing and clamping, have included a great many parts including a plug assembly attached to the conductors themselves and a receptacle assembly for receiving the plug. The plug assembly usually includes a cup or some similar receptacle fitting conductor attached directly to the end of the conductor and a sleeve and lock surrounding the lead sheath.

The receptacle generally is plastic with plug receiving bores having sleeves and compression springs therein that engage the plug cup or contact. This spring tends to push the lead out of the receptacle, but the plug carried locking device engages the receptacle in some way to prevent lead withdrawal.

One such high voltage connector is shown in the Lostumo, et al., U.S. Pat. No. 4,387,947, assigned to the assignee of the present invention. That connector includes a plastic receptacle having a plurality of bores having plug receiving sleeves with coil compression springs therein. The plug includes the lead with a crimped contact over its conductor, a spacer sleeve, a sealing compression ring and a lock nut. The receptacle for each lead includes four parts and the plug including the lead includes four parts as well.

All of these parts increase the cost of the assembly, make assembly more difficult and time consuming, but most of all, the plurality of parts inhibits miniaturization which is highly desirable in today's receiver envelopes where space is a costly premium.

Other high voltage lead connectors have also been provided in the past including the Peters, U.S. Pat. Nos. 2,241,419; the Glover, 3,824,526; the Glover, et al., 3,842,390; the Gaind, 3,941,928; the Issler, et al., 4,019,796, and Hobson, et al., 4,343,526. In all of these connectors, a multiple part plug assembly is required for the lead, which makes assembly difficult and inhibits miniaturization.

For example, in the Gaind, U.S. Pat. No. 3,941,928, the lead must be inserted through the receptacle before attachment of a contact cup to the lead conductor.

It is a primary object of the present invention to ameliorate the problems noted above in high voltage connectors and to provide a quick release connector reducing or eliminating the number of plug parts and minimizing the receptacle parts and its manufacture to facilitate connector miniaturization.

DETAILED DESCRIPTION OF THE PREFERRED EMBODIMENT

In accordance with the present invention, a high voltage connector assembly is provided where the leads themselves without additional plug elements can be inserted directly into the receptacle and sealed and electrically engaged in the receptacle without any additional part manipulation and clamped into the receptacle simultaneously with other leads by a clam shell housing.

The receptacle includes a silicone rubber block that has lead receiving bores that squeeze and seal the leads eliminating the need for separate sealing elements heretofore though necessary in such connectors. A common conduct plate is insert molded into this rubber receptacle eliminating the need for assembling the common conductor at the time the leads are inserted into the receptacle.

The clam shell housing is a two part housing with a quick release locking pin and semi-circular surfaces that engage the opposite sides of the lead sheaths to hold the leads in the rubber receptacle. This housing also provides a convenient location for a mounting bracket for the entire assembly.

Figure 1:
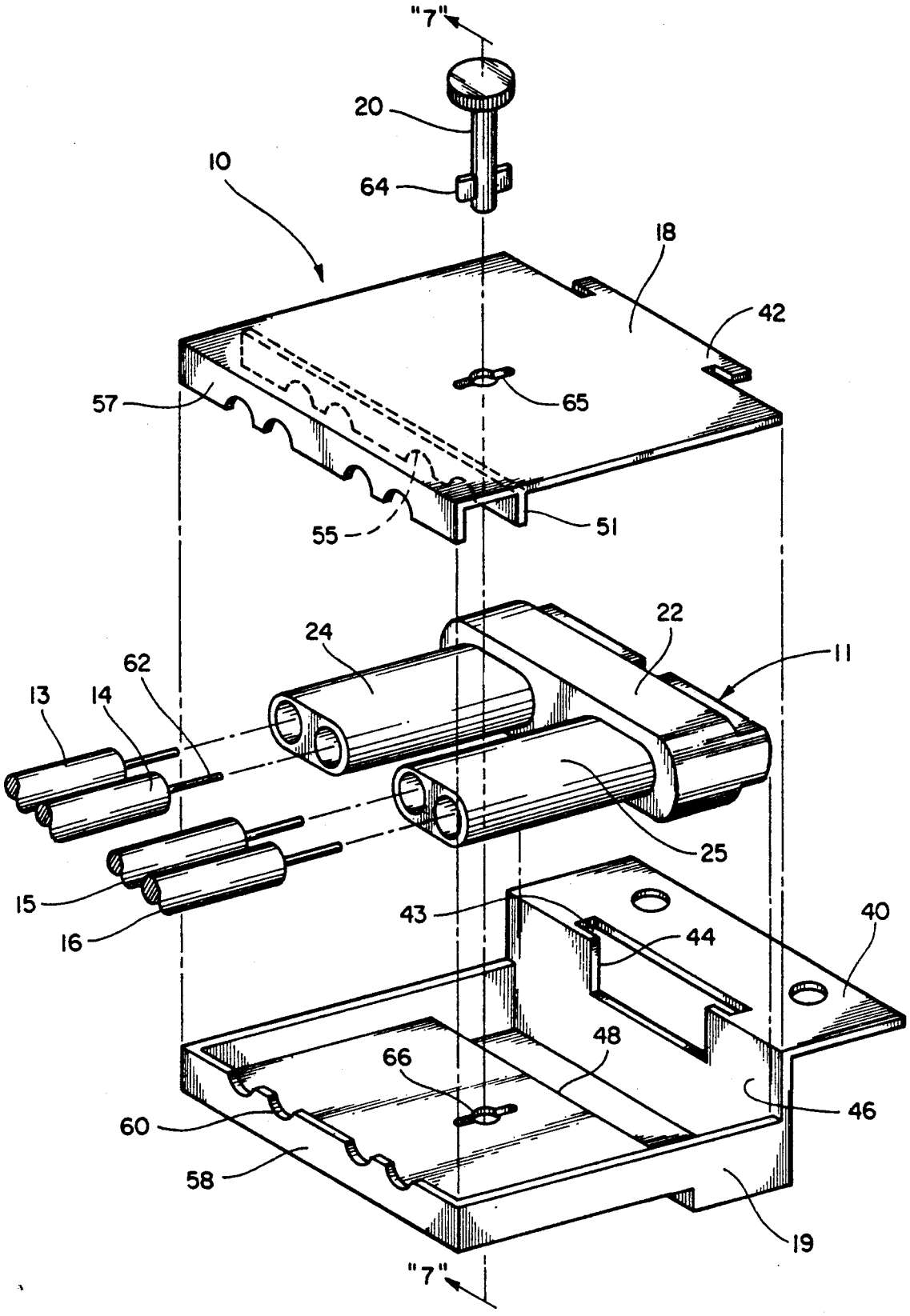
FIG. 1. is an exploded view of a high voltage connector assembly according to the present invention.
Figure 2:
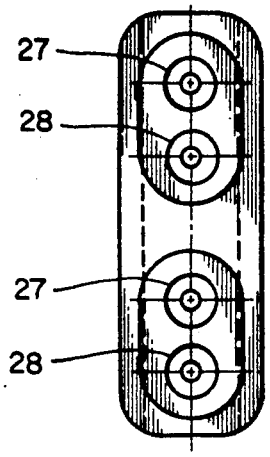
FIG. 2. is a front end view of a rubber receptacle sub-assembly in the connector assembly illustrated in FIG. 1.
Figure 3:
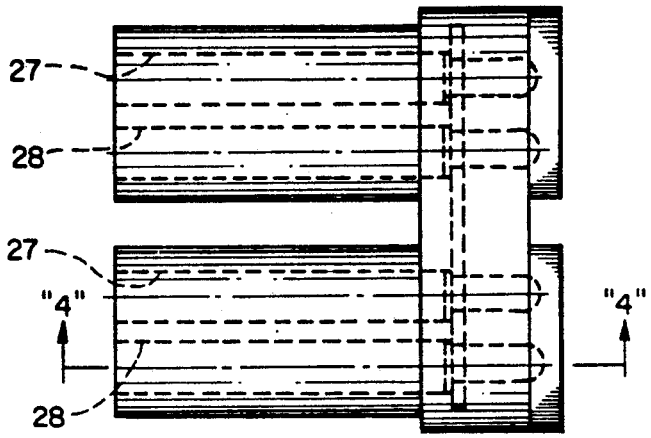
FIG. 3 is a top view of the rubber receptacle illustrated in FIG. 3.

Viewing the drawings and particularly FIG. 1, a high voltage connector 10 is illustrated according to the present invention generally including a one-piece silicone rubber receptacle 11 adapted to receive high voltage anode input leads 13 and 14 and high voltage output leads 15 and 16 adapted to be connected to an adjacent CRT, a clam shell housing including an upper shell 18, a lower shell 19, and a locking pin 20.

The rubber receptacle 11 is constructed of a resilient synthetic rubber having a durometer in the range of Shore A 55, and one such material would be one of the readily available silicone rubbers from Dow-Corning Corporation or General Electric Company.

Receptacle 11 includes a generally rectangular block section 22 with forwardly projecting oblong barrels 24 and 25 each having bores 27 and 28 therein adapted to receive the leads 13 to 16. The diameters of the bores 27 and 28 are slightly less than the diameters of the lead sheaths 30 so that they squeeze and seal on the sheath without the need for any additional sealing elements.

Figure 4:
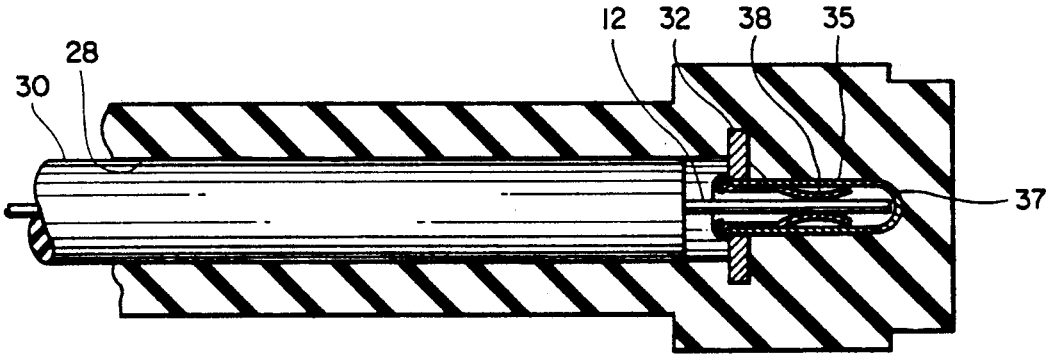
FIG. 4 is an enlarged longitudinal section of the receptacle sub-assembly taken generally along line 4—4 of FIG. 3.
Figure 5:
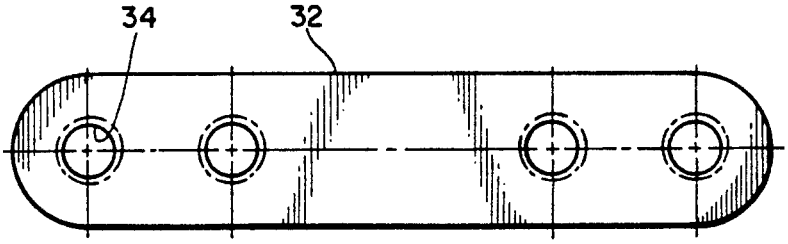
FIG. 5 is a rear view of a common conductor plate insert molded in the receptacle sub-assembly.
Figure 6:
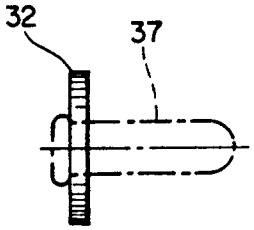
FIG. 6 is an end view of the conductor plate illustrated in FIG. 5 showing a conductor connector in phanton.

As seen in FIGS. 4 and 5, an oblong flat metal conductor plate 32 is insert molded within the block section 22 of the receptacle 11. Conductor plate 32 has four holes 34 therein into which miniature connector 35 are press fit. It should be understood that the drawings are not to scale and in fact are significantly enlarged. In actuality, the entire axial length of the connectors 35 is about 0.250 inches, and the other parts of the connector assembly 10 are shown proportionally sized to the connectors 35.

The connectors 35 by themselves form no part of the present invention except for their cooperation with the other parts illustrated, and each includes a metal drawn conducting cup 37 with a conductor squeezing spring 38 carried therein.

Figure 7:
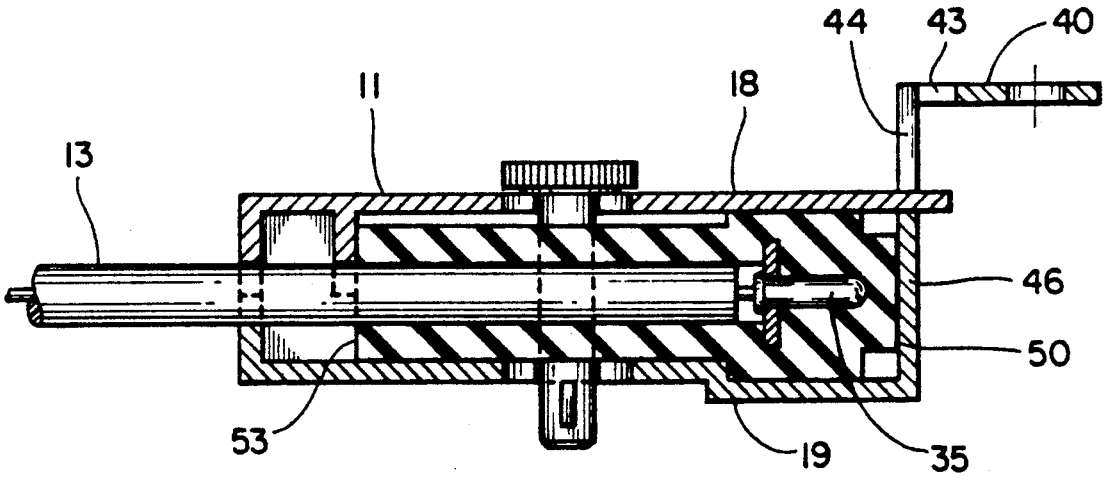
FIG. 7 is a longitudinal section taken through one of the leads in the completely assembled connector assembly according to the present invention.

As seen in FIGS. 1 and 7, the clam shell housing members 18 and 19 are constructed of a rigid plastic material and the lower housing member 19 has a mounting flange 40 that supports the entire assembly 10 in its desired location on or adjacent the associated CRT. Both housing members are generally rectangular and the upper housing member 18 has a tongue 42 that slides through a rectangular opening 43 in the lower housing flange and slides down into an adjacent opening 44 in the housing end wall 46.

The lower housing member 19 has a recess 48 sized to receive the lower part of the block section 22 of the receptacle 11 with its end surface 50 engaging housing wall 46. The upper clam shell housing member 18 has a downwardly projecting wall 51 that when assembled engages receptacle forward wall 53 to axially locate the receptacle 11 in the clam shell housing. Wall 51 has a plurality of semi-circular recesses 55 that provide clearance for the leads 13 to 16.

The clam shell housing members 18 and 19 have forward downwardly projecting walls 57 and 58 that each have four semi-circular recesses 60 therein that clamp and squeeze the conductor sheaths 30 and prevent withdrawal of the leads from the receptacle 11.

The leads 13 to 16 are inserted into the rubber receptacle 11 prior to assembling the clam shell housing and are inserted into the receptacle 11 without requiring any additional plug elements and are engaged with connectors 35 and their conductors 62 are engaged in connector springs 38 without any additional manipulation.

The claim shell housing members 18 and 19 are placed over the receptacle 11 and the locking pin 20 with its camming projections 64 is inserted through complementary openings 65 and 66 in the upper and lower housing members respectively and then rotated to lock the housing members around the receptacle 11 and simultaneously clamp and squeeze the sheaths of the leads 13 to 16 thereby preventing withdrawal of the leads from the receptacle 11.

What is claimed is:

1. An easily connectable and disconnectable high voltage connector for at least one sheathed input lead and one sheathed output lead each having conductors with stripped bare wire ends, comprising: a resilient electrically insulative receptacle having bores for respectively receiving the input and output leads, which bores are sized to squeeze and seal on the sheaths of the leads. common conductor means mounted completely within the receptacle for receiving and electrically interconnecting the conductors, and strain relief means for engaging the conductor sheaths for preventing withdrawal of the conductors from the receptacle, the length of said bores and the resilient constriction of said bores on said lead sheaths along said length of said bores being such that high voltage carried by said conductors can not arc to the outside of said receptacle through said bores, whereby the need for a plug assembly is eliminated and the conductors can be inserted without addtional parts directly into said conductor means encapsulated within the receptacle.

2. An easily disconnectable high voltage connector as defined in claim 1, wherein the common conductor includes a metal plate insert molded in the receptacle.

3. An easily disconnectable high voltage connector as defined in claim 1, wherein the receptacle is silicone rubber having a durometer of approximately 55 Shore A.

4. An easily disconnectable high voltage connector as defined in claim 1, wherein the strain relief means comprises a single quick release radial clamp for both conductors.

5. An easily disconnectable high voltage connector as defined in claim 1, wherein the strain relief means is a clamshell housing clamp for the receptacle.

6. An easily disconnectable high voltage connector as defined in claim 1, wherein the common conductor includes a metal plate having at least two holes therein, metal sub-receptacles press fit into the holes, and springs in the sub-receptacles adapted to receive and resiliently engage the conductors.

7. An easily connectable and disconnectable high voltage connector for at least one sheathed input lead and one sheathed output lead each having conductors with stripped bare wire ends, comprising: an electrically insulative resilient receptacle having bores for respectively receiving the input and output leads, which bores are sized to squeeze and seal on the sheaths of the leads, a common conductor and sub-receptacle assembly insert molded in the receptacle positioned so that the sub-receptacles are aligned with lead receiving bores and so that the bare wire ends of the conductors enter the sub-receptacles as the leads are inserted into the bores, and strain relief means to radially clamp the conductors to the receptacle, the length of said bores and the resilient constriction of said bores on said lead sheaths along said length of said bores being such that high voltage carried by said conductors can not arc to the outside of said receptacle through said bores.

8. An easily disconnectable high voltage connector as defined in claim 7, wherein the receptacle is silicone rubber having a durometer of approximately 55 Shore A.

9. An easily connectable and disconnectable high voltage connector for at least one sheathed input lead and one sheathed output lead each having conductors with stripped bare wire ends, comprising: a resilient receptacle having bores for respectively receiving the input and output leads, which bores are sized to squeeze and seal on the sheaths of the leads, the length of said bores and the resilient constriction of said bores on said lead sheaths along said length of said bores being such that high voltage carried by said conductors can not arc to the outside of said receptacle through said bores, a common conductor means mounted in the receptacle for electrically connecting the conductors, and a quick release clamshell housing for the receptacle having integral surfaces for simultaneously engaging and clamping the sheaths of the leads for preventing lead withdrawal.

10. An easily disconnectable high voltage connector as defined in claim 9, including a quick release pushand-turn locking pin for holding the clam shell housing together.

11. An easily disconnectable high voltage connector as defined in claim 9, wherein the clam shell housing includes first and second mating housing members each having semi-circular aligned surfaces for clamping the conductor sheaths.

* * * * *